US005882270A

United States Patent [19]

Daugherty

[11] Patent Number: 5,882,270

[45] Date of Patent: Mar. 16, 1999

[54] BASEBALL BATTING PRACTICE DEVICE

[76] Inventor: William E. Daugherty, 6425 Perry Rd., Lucana, N.C. 27851

[21] Appl. No.: 806,336

[22] Filed: Feb. 26, 1997

Related U.S. Application Data

[60] Provisional application No. 60/012,244 Feb. 26, 1996.

[51] Int. Cl.[6] ..... A63B 69/40

[52] U.S. Cl. ..... 473/427

[58] Field of Search ..... 473/427, 429

[56] References Cited

U.S. PATENT DOCUMENTS

| | | | |
|---|---|---|---|
| 1,962,087 | 6/1934 | Cone | 473/427 |
| 2,976,040 | 3/1961 | Bales | 473/429 |
| 3,380,738 | 4/1968 | Papp | 473/427 |
| 3,588,104 | 6/1971 | Griffin | 473/427 |
| 3,637,208 | 1/1972 | Allred | 473/427 |
| 3,897,057 | 7/1975 | Pennington | 473/427 |
| 5,018,729 | 5/1991 | Wilkerson | 473/427 |
| 5,083,775 | 1/1992 | Heard | 473/427 |
| 5,184,816 | 2/1993 | Lunsford | 473/427 |

FOREIGN PATENT DOCUMENTS 8-125275A 5/1996 Japan .

*Primary Examiner*—Theatrice Brown

*Attorney, Agent, or Firm*—Mills Law Firm PLLC; Clifford F. Rey

[57] ABSTRACT

At improved centrifugal batting practice machine of the type having a tethered ball that is repeatedly revolved past a hitter by a generally horizontal rotating arm is disclosed. The rotating arm is mechanically coupled to a vertically disposed, motor-driven shaft within a vertical frame that is fixedly attached to a base support. A height adjustment mechanism is interposed between the motor-driven shaft and the rotating arm to permit incremental adjustment thereof in a vertical plane such that the ball is presented to a batter at the desired vertical height. The batting practice machine includes functional features that produce a random pattern in the pitches delivered by batter. In one embodiment the batting practice machine is placed in a condition of imbalance by the removal of detachable pads or feet from the base support to produce a random pattern in the pitches. In another embodiment the rotating arm is pivotally attached to the upper end of the rotating shaft in a counterbalanced condition to permit pivoting movement of the arm in the vertical plane as it is simultaneously rotated in the horizontal plane. In another alternative embodiment the batting practice device is adapted for manual operation by a batting coach or another player without the supporting frame and motor.

3 Claims, 5 Drawing Sheets

BASEBALL BATTING PRACTICE DEVICE

CLAIM OF BENEFIT OF PROVISIONAL APPLICATION

This application claims the benefit under 35 U.S.C. 119(e) of U.S. provisional application Ser. No. 60/012,244 filed on Feb. 26, 1996 by William E. Daugherty for Baseball Batting Practice Device.

BACKGROUND OF INVENTION

This invention relates to baseball batting practice devices and, more particularly, to a batting practice machine which presents the batter with a tethered ball that repeatedly revolves past the batter simulating a ball that has been pitched.

Centrifugal batting practice machines are well known to those skilled in the art. Typically, such batting practice machines include a ball tethered to the end of a cord that is revolved in a horizontal plane about a motorized base unit. A batter approaches the operating machine and positions him or herself adjacent the path described by the rotating machine to hit the ball with a bat as it circles past. For example, U.S. Pat. Nos. 4,872,675 and 5,184,816 disclose baseball batting practice devices which are designed to swing a tethered ball in a substantially horizontal path to repeatedly present the batter with a moving baseball to allow hitting practice.

However, the batting practice machines of the prior art tend to present the ball to the batter at a consistent vertical location at a constant rate of speed. Although such a device will provide useful practice to the beginning player, a batting practice machine capable of simulating pitches of various speeds and vertical locations has obvious advantages.

Thus, the present invention has been developed to provide a batting practice machine which operates to produce randomness in the pitches delivered so that the batter is unable to anticipate the next pitch thereby increasing his batting skills.

DESCRIPTION OF RELATED PRIOR ART

U.S. Pat. No. 5,184,816 to T. J. Lunsford discloses a hitting practice device comprising a rotatable arm attached to a shaft which is driven by a motor disposed in a generally vertical frame. Attached to one end of the arm is a tethered ball which is propelled repeatedly past a batter to allow hitting practice.

U.S. Pat. No. 4,872,675 to Horace Crowden discloses a baseball pitching device which presents a batter with a moving ball simulating a ball that has been pitched. The pitching device is designed to swing a tethered ball in a substantially horizontal path thereby presenting a batter with a moving baseball.

U.S. Pat. No. 5,018,729 to Cecil L. Wilkerson discloses a batting practice machine including an adjustable rotatable arm mounted on a vertical frame being mechanically coupled to a motor and drive mechanism for rotating the arm in a generally horizontal circle moving a ball along a horizontal circular path for repeated presentation to a batter.

U.S. Pat. No. 5,275,396 discloses a portable batting practice machine wherein a tethered ball is swung around a generally circular path in a forward direction and a batter periodically swings a bat or racket in an attempt to hit the ball in the opposite direction.

U.S. Pat. No. 5,083,775 to Martin P. Heard discloses a pitching machine for mechanically pitching the ball to a batter for the purpose of batting practice. The pitching machine has several elements for varying the pitch of the ball so that the batter is less likely to be able to anticipate the next pitch.

U.S. Pat. No. 3,637,208 to Aubrey M. Allred discloses a baseball batting practice device including a lateral arm which supports a ball cord and is driven by a variable speed reversible electric motor. A second reversible motor and screw mechanisms selectively adjust the height of the lateral arm to determine the height of the ball from the ground. The two motors are driven at the same time from remote controls so that the batter does not know the elevation or the speed of the ball when he swings a bat and tries to hit the ball as it approaches him.

U.S. Pat. No. 3,588,104 to Billy J. Griffin discloses a baseball batting training device including a tethered baseball attached to a boom rotatable by a fixed center. The radius between the ball and the rotational center of the boom may be selectively to change the type of pitch as the ball passes the batter and the boom may be raised or lowered to selectively change the height of the pitch as it passes the batter.

U.S. Pat. No. 3,885,790 to Lee Roy Parr discloses a fully automatic centrifugal baseball pitching machine allowing a tethered ball to be driven in the opposite direction when impacted by the batter. A foot operated brake to create changes in the type of pitch and a retractor mechanism automatically takes up slack in the tether line.

U.S. Pat. No. 2,058,277 to Benjamin Walther discloses a baseball practice machine including a tethered baseball attached to a generally horizontal rotatable arm coupled to a motor driven vertical shaft which repeatedly presents the baseball to a batter.

U.S. Pat. No. 3,333,847 to Donald D. Pennington discloses a batting practice device with foot responsive clutch drive in which a tethered baseball is attached to a generally horizontal, rotatable arm to present the ball to a batter for batting practice.

Finally, U.S. Pat. No. 3,408,070 to Anthony A Gonzales discloses a revolving baseball toy comprising magnetic clutch means in which a tethered ball is repeatedly rotated in a horizontal plane to simulate a pitched baseball.

SUMMARY OF THE INVENTION

After much research and study of the above mentioned problems, the present invention has been developed to provide an improved centrifugal batting practice machine which presents a batter with a moving ball simulating a ball which has been thrown or pitched.

The practice machine of the present invention includes a ball tethered to the end of an adjustable rotating arm that is mechanically coupled to a vertically disposed motor driven shaft mounted on a supporting frame.

The rotating arm is provided with an adjustment mechanism which permits vertical height adjustment of the ball in relation to the ground surface. The batting practice device of the present invention includes features for placing the device in an out-of-balance condition to produce a randomness in the pitches delivered to the batter so that there is no regular pattern that can be anticipated. In normal use the batter approaches the operating device and positions himself as if standing up to the plate to bit the ball as it circles past.

In the preferred embodiment the batting practice device is driven by a standard electrical motor mechanically coupled to the rotating shaft by a belt and pulley mechanism.

In an alternative embodiment, the vertical shaft and adjustable rotating arm with the ball tethered thereto are manually operated without the supporting frame or motor by a batting coach or other player.

In view of the above, it is an object of the present invention to provide an improved batting practice device which presents a batter with a moving ball simulating a ball which has been thrown or pitched.

Another object of the present invention is to provide a batting practice device having functional elements to produce a randomness in the pitches so that batter is unable to anticipate the speed and location of the next pitch thereby increasing her batting skills.

Another object of the present invention is to provide a batting practice device including a tethered ball attached to an adjustable rotating arm which is mechanically coupled to a vertically disposed motor driven shaft by a convention belt and pulley mechanism.

Another object of the present invention is to provide an improved batting practice device having a tethered ball attached to an adjustable rotating arm coupled to a vertically rotating shaft which can be manually operated by a batting coach or other player.

Other objects and advantages of the present invention will become apparent and obvious from a study of the following description and the accompanying drawings which are merely illustrative of such invention.

DETAILED DESCRIPTION OF THE PREFERRED EMBODIMENT

Figure 1:
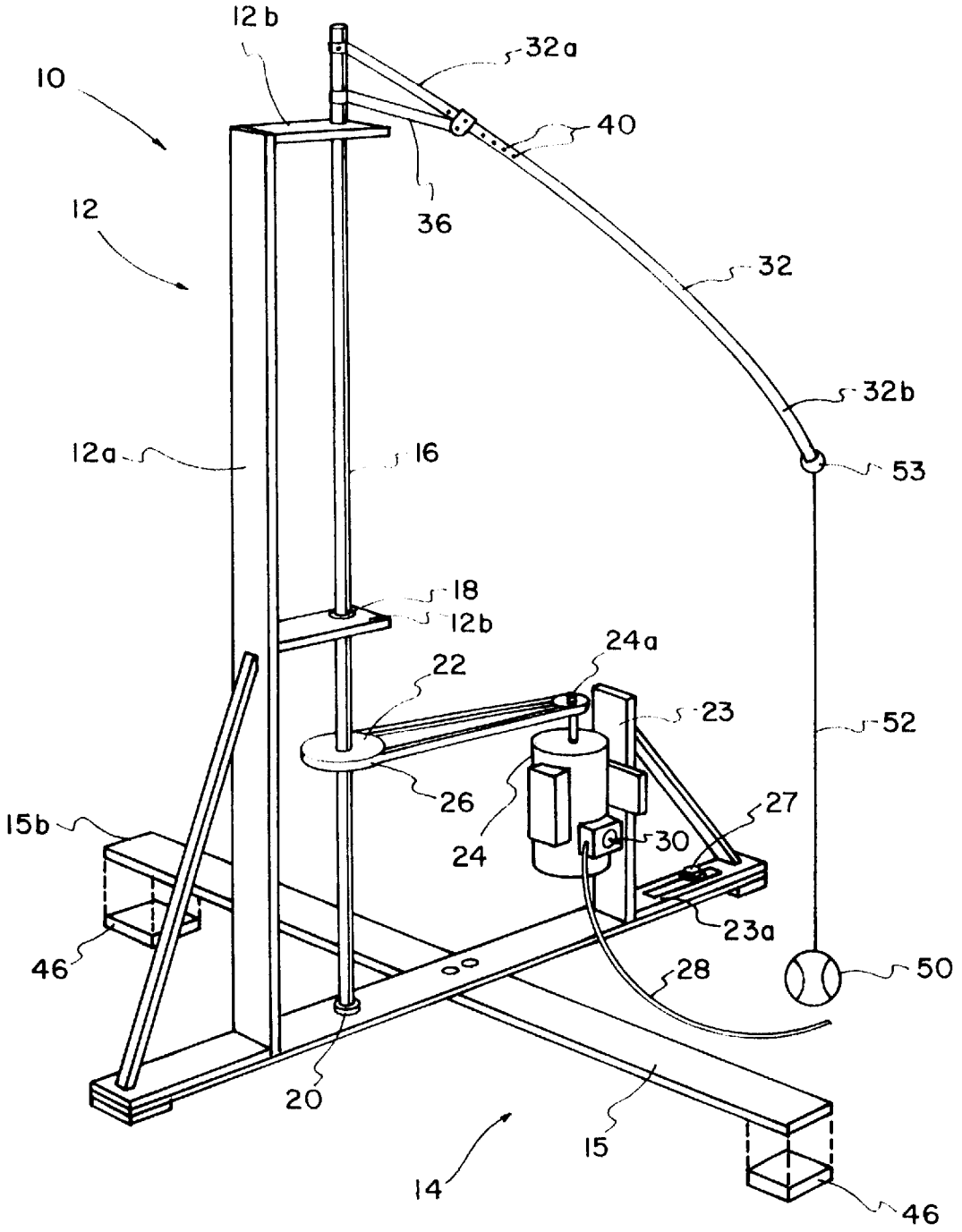
FIG. 1 is a perspective view of the improved batting practice device of the present invention showing the overall construction thereof.

With reference to the drawings, a batting practice machine in accordance with the present invention is illustrated in FIG. 1 and indicated generally at 10.

Batting practice machine 10 includes a vertical frame indicated generally at 12, that is fixedly attached to a base support, indicated generally at 14.

Frame 12 and base support 14 are adapted to receive a vertically mounted drive shaft 16 thereon. Frame 12 includes an upright member 12*a* which is provided with a pair of horizontally opposed mounting brackets 12*b* extending perpendicularly therefrom.

Mounting brackets 12*b* each include a bearing journal 18 having a common axis of symmetry, which are adapted to permanently retain shaft 16 therein in its functional position.

Base support 14 is provided with a bearing cup 20 which is positioned in alignment with bearing journals 18 and adapted to receive a bottom end of shaft 16 being imparted with 360 degree rotational motion therein.

Shaft 16 includes a drive pulley 22 which is installed at a predetermined vertical height so as to be driven by a means such as motor 24 connected thereto by belt 26.

Motor 24 is mounted on frame 12 and if it is electric, it is connected to standard 120 volt power source by power cord 28 through switch 30 in order to operate the batting practice device 10.

Figure 2:
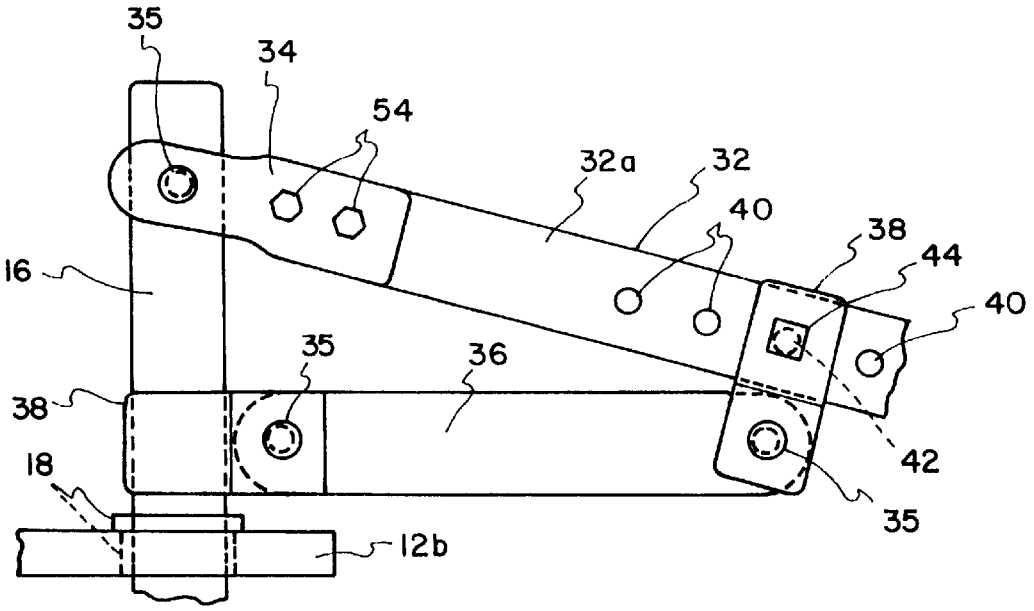
FIG. 2 is an enlarged elevational view of the adjustment mechanism for the rotating arm component of the batting practice device.

Turning now to FIG. 2, it will be appreciated that rotating arm 32 is mechanically coupled to shaft 16 at the upper end thereof. It can be seen that a proximal end 32*a* of arm 32 is adapted for pivoting movement with the upper end of shaft 16.

Arm 32 is imparted with pivoting movement in a vertical plane by means of a yoke fitting 34 that is fixedly attached to the proximal end 32*a* of arm 32 by bolts 54. Yoke fitting 34 is pivotally attached to the upper end of shaft 16 by pivot pin 35 which extends through an aperture (not shown) formed near the upper end of shaft 16 in perpendicular relation to an axis thereof.

Still referring to FIG. 2, it can be seen that an adjustment arm 36 is installed between rotating arm 32 and shaft 16 adjacent yoke fitting 34 described above.

Adjustment arm 36 is provided with a pair of external pipe clamps 38 which are pivotally attached at either end thereof by pivot pins 35.

Since such external pipe clamps are well known to those skilled in the art, further detailed discussion of the same is not deemed necessary.

Pipe clamps 38 are adapted for sliding engagement about the outside diameter of shaft 16 on one end of arm 36 and about rotating arm 32 on an opposite end thereof.

Rotating arm 32 is provided with a plurality of adjustment apertures 40 positioned near the proximal end 32*a* thereof at regular intervals to provide for a vertical height adjustment of ball 50 as described in further detail hereinafter.

The pipe clamp 38 which is adapted for sliding engagement with arm 32 is provided with a locating hole 42 which may be selectively aligned with any of the plurality of adjustment apertures 40 in order to set the vertical height position of ball 50 as it will be presented to the batter (not shown).

It will be appreciated by those skilled in the art that the vertical height of ball 50 may be raised or lowered by sliding the locating hole 42 within its associated pipe clamp 38 into alignment with a selected adjustment aperture 40 on rotating arm 32. A retaining pin 44 is inserted through locating hole 42 positioned in alignment with the selected adjustment aperture 40 to set arm 32 in the desired position.

In this manner the vertical height of ball 50 as it is presented to a batter using machine 10 may be adjusted to correspond to the height of the batter.

In the normal use of the invention, the batting practice machine 10 as shown in FIG. 1 is positioned on a generally level playing surface in proximity to a 120 volt power supply and plugged in.

The arm 32 is preferably between 6 and 8½ feet in length while the cord 52 is preferably between 4 and 5½ feet in length Next, a tethered ball 50 is attached to the terminal end 32*b* of rotating arm 32 by a suitable fastening means such as ring 53 attached to cord 52.

It is critical to present invention that the rotating arm 32 and attached cord 52 describes a radius in the range of 10 to 14 feet and, thus, a diameter of 20 to 28 feet in the normal use of the batting practice machine 10 in order to simulate a pitched ball in the range of 30 to 100 miles per hour.

Next, switch 30 is engaged to select either clockwise or counterclockwise rotation of machine 10 corresponding to either a right or left-handed batter and operation is started. The motor 24 drives the shaft 16 through belt 26 to rotate arm 32 about frame 12 and propels the ball 50 repeatedly past the batter to allow batting practice.

Minimal tension is applied to belt 26 so that when impacted by the batter, the tethered ball 50 may be driven in the opposite direction causing momentary reverse rotation of shaft 16 and slippage of belt 26 within drive pulley 22. However, the reverse rotation caused by the batter's impact with the ball 50 is quickly overcome by motor 24 and rotation in the original direction is resumed.

The tension applied to belt 26 may be adjusted by providing a slotted bracket member 23*a* on the motor support 23 which is secured to cross member 15 by machine bolt 27.

Thus the linear distance between the shaft 16 and motor shaft 24*a* can be varied to adjust the tension on belt 26 in a known manner.

In the preferred embodiment, base support 14 includes a pair of cross members 15 being fixedly attached at their respective mid-points and arranged in perpendicular relation to provide adequate support for the batting practice machine 10 in operation.

Figure 3:
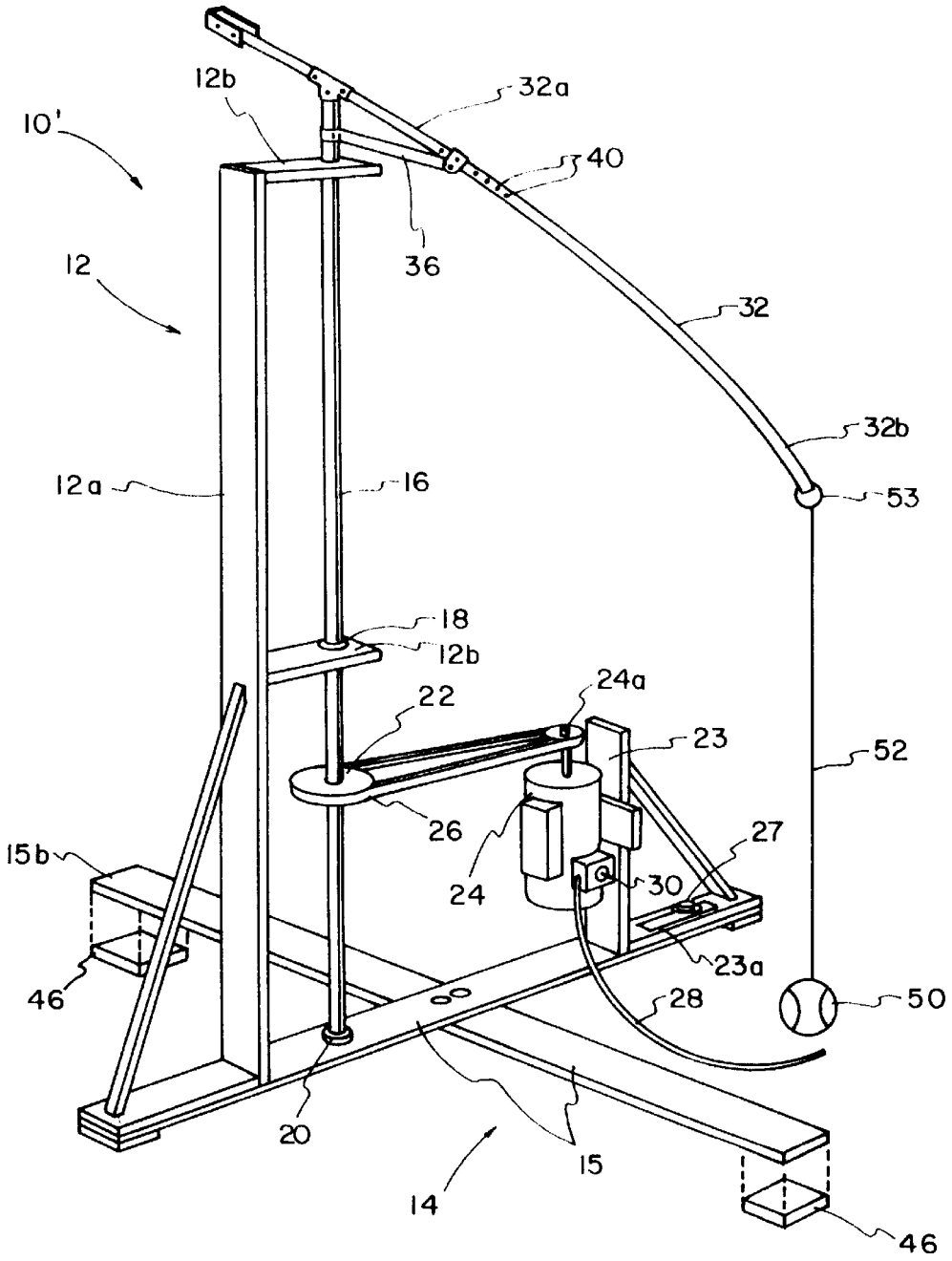
FIG. 3 is a perspective view of an alternative embodiment of the batting practice device including a modified rotating arm with a counterbalance assembly attached thereto.

As shown in FIG. 1, transverse cross member 15*b* may be provided with a plurality of detachable pads 46 which are positioned at predetermined locations on the bottom surface thereof. Pads 46 function to render the bottom surface uneven when installed on the cross member 15*b* as shown in FIG. 3 and to maintain the entire batting practice machine 10 in a out-of-balance condition to produce a slight rocking movement during operation. This rocking motion produces a randomness in the pitches delivered to the batter such that there is no regular pattern which may be anticipated by the batter.

Of course, pads 46 may be removed as shown in FIG. 1 such that machine 10 is placed in a condition of balance during operation in order to produce a repeating pattern in the pitches delivered, if desired. This is particularly advantageous when used with new players who need to build confidence before moving to the random pitch pattern.

Turning now to FIG. 3 there is shown therein an alternative embodiment of the batting practice device indicated generally at 10'. In this embodiment it can be seen that the rotating arm 32' is provided with a modified T-fitting, indicated generally at 55 which is mechanically coupled to a counter balance assembly, indicated generally at 60, as more clearly shown in FIG. 4.

T-fitting 55 includes a downwardly extending leg 55*a* that is modified to be pivotally coupled to the upper end of shaft 16 imparting pivoting movement to arm 32 in a vertical plane simultaneously with its generally horizontal rotation about shaft 16 in operation.

Figure 4:
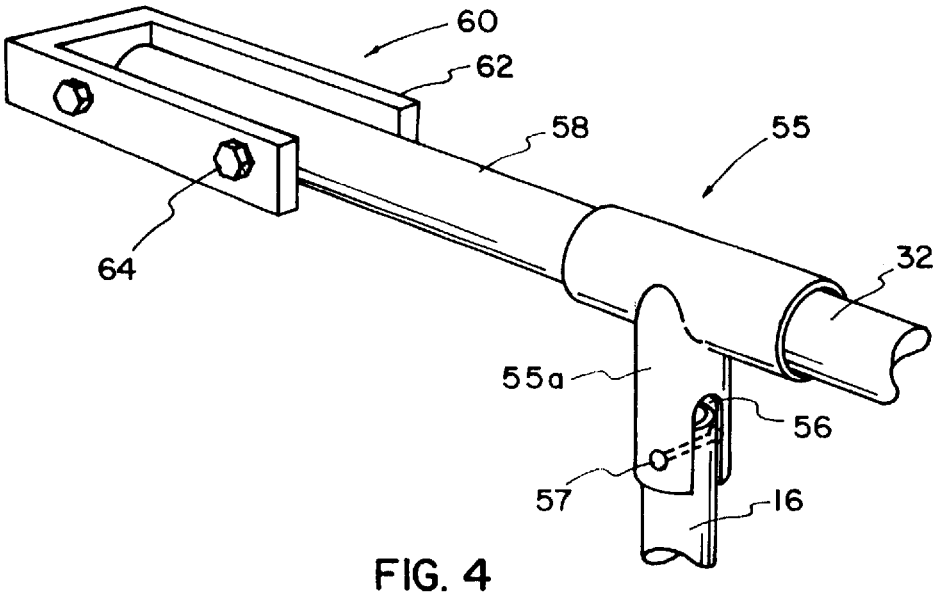
FIG. 4 is an enlarged elevational view of the modified rotating arm illustrated in FIG. 3 showing the details of the counterbalance assembly.

This vertical pivoting movement is accomplished by manufacturing a central slot 56 through a centerline of downwardly extending leg 55*a* in a plane which is generally parallel to that plane dividing T-fitting 55 into symmetrical halves. Slot 56 is configured and dimensioned to provide clearance for the upper end of shaft 16 that is secured in pivoting relation to the T-fitting 55 by means of a pivot pin 57 as shown in FIG. 4.

In this configuration T-fitting 55 is adapted to receive an arm extension 58 which is mechanically coupled to a counterweight 62 by machine screws 64.

The counterweight 62 is designed to counteract the weight of the ball 50 during rotation and to dampen the effect of the batter's impact on arm 32 as the ball is struck by the bat.

The counterbalance assembly 60 also functions to impart a wobbling movement to the rotating arm 32 due to its mass and inertia and produces randomness in the pitches delivered to the batter to prevent the user from anticipating the position of the next pitch. This is a particular advantage when used with more advanced players who wish to improve their batting skills.

In the preferred embodiment the counterweight 62 is fabricated in a generally U-shaped configuration so as to distribute its weight on either side of the arm extension 58. Of course, additional weights (not shown) may be attached to the counterweight 62 by use of machine screws 64 if desired to produce the desired movement of arm 32 during use and the corresponding randomness of pitches delivered to the batter.

Figure 5:
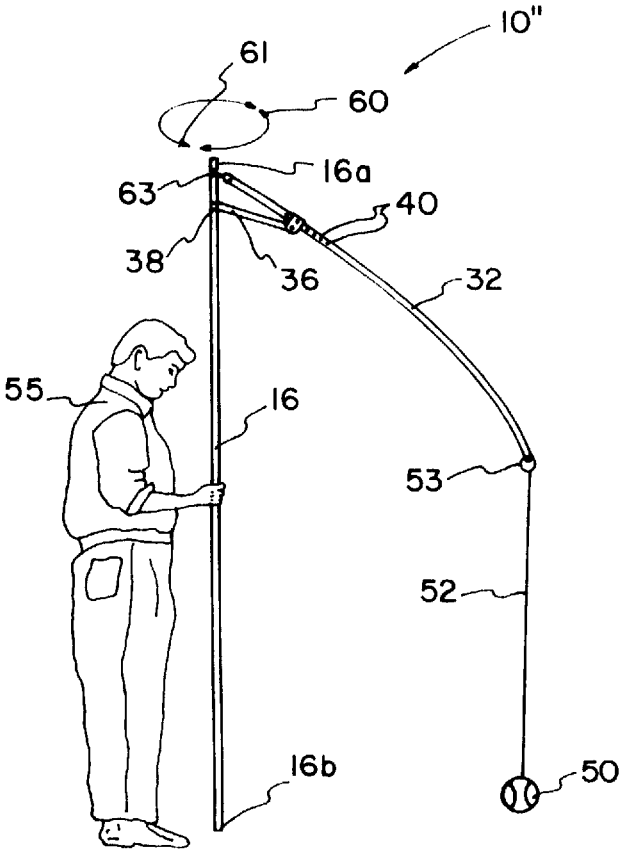
FIG. 5 is a perspective view of another alternative embodiment of the batting practice device of the present invention adapted for manual operation.

In yet another alternative embodiment of the present invention, batting practice machine 10" may be adapted for manual operation as shown in FIG. 5 of the drawings. In this embodiment, shaft 16 together with rotating arm 32 are manipulated by a batting coach 55 or other person to repeatedly revolve the tethered ball 50 past the batter (not shown) to simulate a ball that has been pitched.

In the normal operation of this embodiment of the batting machine, the batting coach 55 or other user of the device grasps shaft 16 at its approximate midpoint and by a revolving movement of the hand and forearm imparts 360 degree rotational movement of rotating arm 32 about an axis of shaft 16.

Using this technique, an upper end 16*a* of shaft 16 describes a generally circular pattern in either a clockwise or counter-clockwise direction as indicated by directional arrows 60 and 61. The lower end 16*b* of shaft 16 remains stationary and serves as a pivot point for shaft 16.

Figure 6:
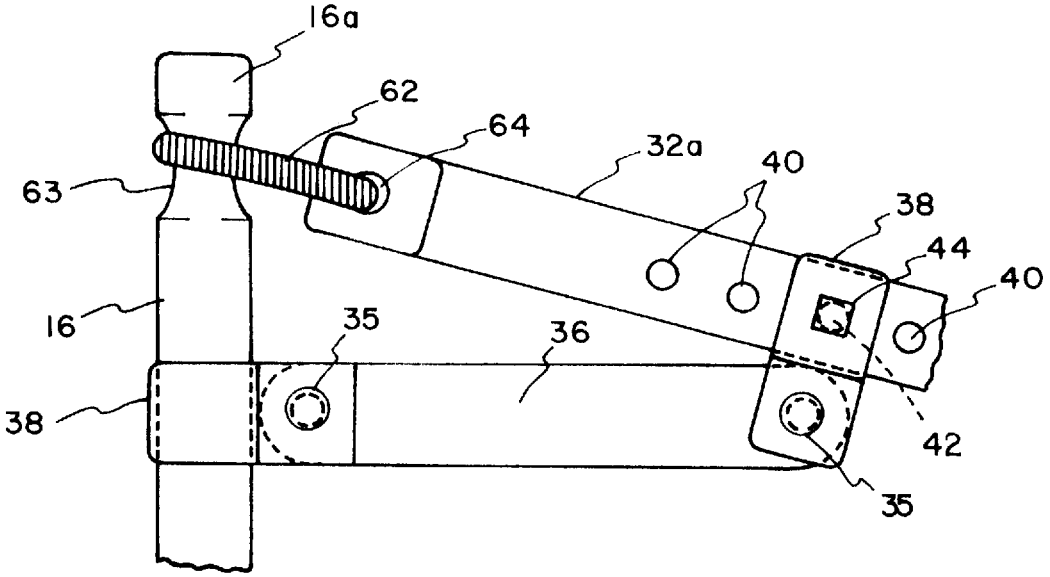
FIG. 6 is an enlarged elevational view of the rotating arm of the alternative embodiment as illustrated in FIG. 5 showing the details of the construction thereof.

It will be appreciated that in this embodiment of the batting machine, the upper end 16*a* of shaft 16 has been modified to facilitate the rotation of arm 32 about the shaft 16 as shown in FIG. 6.

In this embodiment, a portion of shaft 16 adjacent the upper end 16*a* thereof has a reduced diameter as at 63 having a radius formed therein. It can be seen that the proximal end 32*a* of arm 32 is also modified to include a mounting aperture 64 wherein a length of rope 62 or other suitable connecting means may be secured. Rope 62 is then attached at the other end thereof to the tipper end 16*a* of shaft 16 within the radius portion 63 thereof to facilitate the free rotation of arm 32 about shaft 16.

It will be appreciated that pipe clamp 38 is provided with sufficient internal clearance about the outside diameter of shaft 16 to permit the free rotation thereof about the shaft 16 during manual operation of this version of the batting machine.

From the above, it can be seen that the present invention provides a batting practice machine that is adaptable to players ranging from beginning to advanced skill levels. The batting machine may be adjusted to present a tethered ball to the batter at various vertical heights and speeds.

In one embodiment, the batting practice machine may be adjusted to a condition of imbalance to produce a slight rocking motion during operation. This rocking motion produces a randomness in the pitches delivered to the batter.

In an alternative embodiment the rotating arm of the batting practice machine is pivotally mounted and counterbalanced to impart pivoting movement to the arm in a vertical plane during operation to produce even more randomness in the pitches delivered the batter to develop advanced batting skills.

Finally, the batting practice machine is available in a manually operated version which may be manufactured at substantially less cost than the motor driven embodiment.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. An improved centrifugal batting practice machine having a tethered ball attached thereto that is repeatably revolved past a hitter by a generally horizontal rotating arm, said rotating arm being mechanically coupled by attaching means to a vertically disposed, drive shaft at an upper end thereof, said drive shaft being mechanically coupled to an electric motor, said drive shaft being rotatably mounted within a vertical frame, said frame being fixedly attached to a base support, said improvements comprising:

height adjusting means interposed between said drive shaft and said rotating arm, said height adjusting means including an elongated adjustment arm being mechanically coupled at one end thereof to said drive shaft adjacent a top end thereof in perpendicular relation thereto, said adjustment arm being adapted for sliding engagement with said rotating arm at an opposite end thereof and being further adapted for interlocking engagement with a plurality of adjustment apertures formed in said rotating arm at predetermined intervals to permit said rotating arm to be incrementally adjusted at varying angles in a vertical plane such that the vertical height of said ball may be adjusted in relation to said batter; and balancing means attached to a bottom surface of said base support; said balancing means being a plurality of removable attached pads for supporting said bottom surface a predetermined distance above a machine support surface; said machine being in a state of imbalance when said plurality of pads are attached to said base support at predetermined locations thereon and therefore cause said machine to exhibit a rocking motion and said ball to travel in a random arcuate path; and said machine being in a balanced state when said selected ones of said pads are detached form said base support, therefore, producing a repeating arcuate pattern of pitches of delivering said ball to a batter.

2. The improved batting practice machine of claim 1 wherein said rotating arm means is fabricated from a flexible tubular material.

3. The improved batting practice machine of claim 2 wherein said tubular material is polyvinylchloride.

* * * * *